US010349785B2

(12) United States Patent
Takagi

(10) Patent No.: US 10,349,785 B2
(45) Date of Patent: Jul. 16, 2019

(54) FOAM DISCHARGE DEVICE

(71) Applicant: Kao Corporation, Tokyo (JP)

(72) Inventor: Yoshimasa Takagi, Suginami-ku (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 15/570,007

(22) PCT Filed: Apr. 28, 2016

(86) PCT No.: PCT/JP2016/063463
§ 371 (c)(1),
(2) Date: Oct. 27, 2017

(87) PCT Pub. No.: WO2016/175316
PCT Pub. Date: Nov. 3, 2016

(65) Prior Publication Data

US 2018/0153353 A1 Jun. 7, 2018

(30) Foreign Application Priority Data

Apr. 28, 2015 (JP) ..... 2015-092397

(51) Int. Cl.
*A47K 5/12* (2006.01)
*B05B 1/02* (2006.01)
(Continued)

(52) U.S. Cl.
CPC ..... *A47K 5/1207* (2013.01); *A47K 5/1217* (2013.01); *A47K 5/14* (2013.01);
(Continued)

(58) Field of Classification Search
CPC ..... A47K 5/1207; A47K 5/12; A47K 5/1217; A47K 5/14; A47K 5/16; B05B 1/02; B05B 7/005; B05B 7/26; B05B 12/122
(Continued)

(56) References Cited

U.S. PATENT DOCUMENTS 4,346,848 A * 8/1982 Malcolm ..... B05B 1/02 239/596
5,813,785 A * 9/1998 Baudin ..... B65D 83/285 401/190
(Continued)

FOREIGN PATENT DOCUMENTS

CN 101259456 A 9/2008
CN 101284591 A 10/2008
(Continued)

OTHER PUBLICATIONS

U.S. Appl. No. 15/531,288, filed May 26, 2017, Hirata.
(Continued)

*Primary Examiner* — Lien M Ngo
(74) *Attorney, Agent, or Firm* — Oblon, McClelland, Maier & Neustadt, L.L.P.

(57) ABSTRACT

The present invention relates to a foam dispensing apparatus including a nozzle portion that mixes a liquid with gas so as to dispense the liquid in a form of a foam. The nozzle portion includes: a foam generation mechanism including a gas liquid mixing portion in which the liquid and the gas are mixed and a first porous body that is disposed downstream of the gas liquid mixing portion; a cavity that is located below the first porous body and whose cross-sectional area defined by a plane perpendicular to a foam dispensing direction T is larger than the area of the first porous body; and a foam dispensing outlet that dispenses foam that has passed through the cavity to an outside. The foam dispensing outlet is configured so as to form shaped foam having a predetermined shape, and an opening area of the foam dispensing outlet that is on the cavity side is smaller than the cross-sectional area of the cavity.

19 Claims, 5 Drawing Sheets

(51) Int. Cl.

| | |
|---|---|
| ***B05B 7/26*** | (2006.01) |
| ***A47K 5/14*** | (2006.01) |
| ***B05B 7/00*** | (2006.01) |
| ***B05B 12/12*** | (2006.01) |
| ***A47K 5/16*** | (2006.01) |

(52) U.S. Cl.
CPC ..... *A47K 5/16* (2013.01); *B05B 1/02* (2013.01); *B05B 7/005* (2013.01); *B05B 7/26* (2013.01); *B05B 12/122* (2013.01)

(58) Field of Classification Search
USPC .... 222/190, 575, 321.1, 321.7–321.9, 383.1, 222/383.3, 135, 145.5, 255, 325
See application file for complete search history.

(56) References Cited

U.S. PATENT DOCUMENTS

| | | | | |
|---|---|---|---|---|
| 9,511,381 | B2 * | 12/2016 | Takahashi | B05B 1/02 |
| 9,687,122 | B2 * | 6/2017 | Harris | B05B 7/0018 |
| 9,731,890 | B2 * | 8/2017 | Ophardt | A47K 5/1207 |
| 2011/0101031 | A1 * | 5/2011 | Hagleitner | A47K 5/16 222/190 |
| 2013/0037573 | A1 * | 2/2013 | Spiegelberg | A47K 5/14 222/190 |
| 2013/0315031 | A1 * | 11/2013 | Bunoz | B05B 7/0037 366/182.2 |
| 2014/0061246 | A1 | 3/2014 | McNulty et al. | |
| 2014/0367419 | A1 * | 12/2014 | Harris | A47K 5/14 222/190 |
| 2015/0196170 | A1 * | 7/2015 | Harris | A47K 5/1211 222/190 |

FOREIGN PATENT DOCUMENTS

| | | | |
|---|---|---|---|
| EP | 3 225 564 | A1 | 10/2017 |
| JP | 2009-178685 | A | 8/2009 |
| JP | 2009-226384 | A | 10/2009 |
| JP | 3159292 | U | 4/2010 |
| JP | 2010-149060 | A | 7/2010 |
| JP | 2013-212244 | A | 10/2013 |
| JP | 2016-108050 | A | 6/2016 |
| JP | 2017-012972 | A | 1/2017 |
| WO | WO 2014/036067 | A1 | 3/2014 |
| WO | 2014/201322 | A1 | 12/2014 |

OTHER PUBLICATIONS

Extended European Search Report dated Nov. 15, 2018 in corresponding European Patent Application No. 16786592.2, 8 pages.
International Search Report dated Aug. 9, 2016 in PCT/JP2016/063463, filed Apr. 28, 2016.

* cited by examiner

FOAM DISCHARGE DEVICE

CROSS REFERENCE TO RELATED APPLICATION

This application is a national phase application of PCT/JP2016/063463, filed Apr. 28, 2016, the entire content and disclosure of which is incorporated into the present application.

TECHNICAL FIELD

The present invention relates to a foam dispensing apparatus.

BACKGROUND ART

A foam dispensing apparatus that mixes a liquid soap with gas and dispenses the liquid soap in the form of mousse-like foam is known (Patent Literature 1).

A technique is also proposed in which foam is dispensed such that the dispensed foam has a specific shape. For example, Patent Literature 2 proposes a foam dispensing apparatus in which a foam dispensing adapter including a plurality of dispensing outlets that have specific diameters and are arranged at specific positions is attached to a nozzle head of a foam pump-equipped container for dispensing foamed content liquid through a nozzle in response to an operation of pressing the nozzle head so as to form shaped foam imitating the shape of a character with a single pressing operation.

CITATION LIST

Patent Literature

Patent Literature 1: JP 2013-212244A
Patent Literature 2: JP 2010-149060A

SUMMARY OF INVENTION

The present invention relates to a foam dispensing apparatus including a nozzle portion that mixes a liquid with gas so as to dispense the liquid in a form of foam. The nozzle portion includes: a foam generation mechanism including a gas liquid mixing portion in which the liquid and the gas are mixed and a first porous body that is disposed in a discharge outlet of the gas liquid mixing portion; a cavity that is located below the first porous body and whose cross-sectional area defined by a plane perpendicular to a foam dispensing direction is larger than an area of the discharge outlet of the gas liquid mixing portion; and a foam dispensing outlet that dispenses foam that has passed through the cavity to an outside. The foam dispensing outlet is configured so as to form shaped foam having a predetermined shape, and an opening area of the foam dispensing outlet that is on the cavity side is smaller than the maximum value of the cross-sectional area of the cavity.

DESCRIPTION OF EMBODIMENTS

With the technique disclosed in Patent Literature 1, it is difficult to shape foam into a desired shape even when attempting to dispense shaped foam. Also, with the technique proposed by Patent Literature 2, it is difficult to adjust the flow of foam flowing into the plurality of dispensing outlets and the amount of foam dispensed. In addition, depending on the shape of the shaped foam, it is difficult to form shaped foam having a desired shape.

The present invention relates to a foam dispensing apparatus capable of forming shaped foam to have a desired predetermined shape in a stable manner.

Hereinafter, the present invention will be described based on a preferred embodiment of the present invention.

Figure 1:
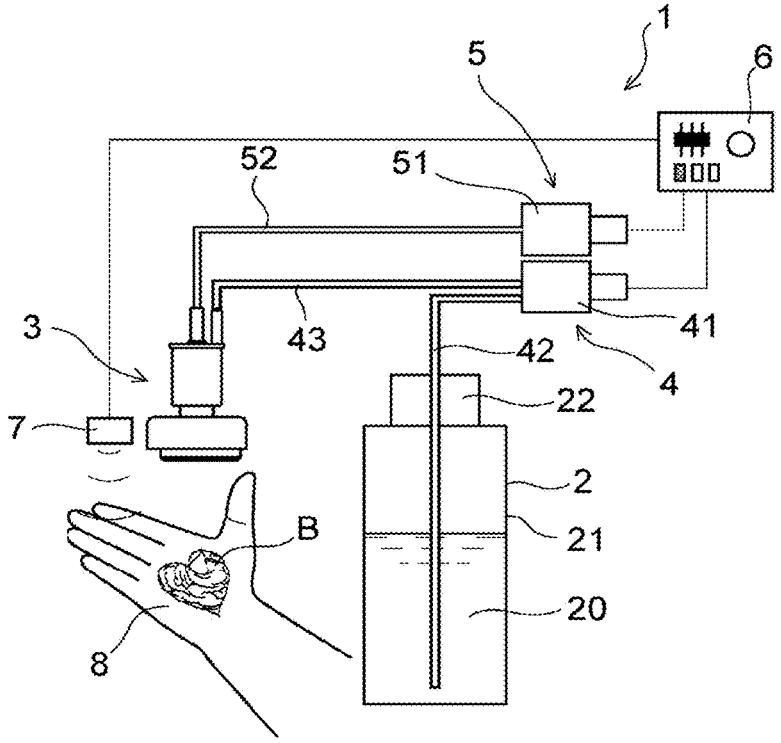
FIG. 1 is a schematic diagram showing an overall configuration of a foam dispensing apparatus of an embodiment of the present invention.

As shown in FIG. 1, a foam dispensing apparatus 1 of an embodiment of the present invention is a foam dispensing apparatus including a nozzle portion 3 that mixes a liquid 20 with gas and dispenses the liquid 20 in the form of foam, the liquid 20 being a liquid soap, and the gas being air. With the foam dispensing apparatus 1 of the present embodiment, a fixed amount of foam is dispensed when a foam receiver 8 such as a human hand or a cleaning sponge is placed under the nozzle portion 3, and a shaped foam B having a desired predetermined shape can be formed on the foam receiver 8 in a stable manner. FIG. 1 shows an example in which foam is dispensed onto the palm of a human hand, which is the foam receiver 8, and shaped foam B having the contour of a heart is formed on the palm of the hand. However, in the case where the foam receiver 8 is a human hand, foam may be dispensed on the back of the hand.

The foam receiver 8 is an article or a part of the body that can receive foam dispensed from the nozzle portion 3, and may be a dust cloth, a cleaning sheet, the top of a desk or the like, instead of a human hand or a cleaning sponge mentioned above.

To be more specific, the foam dispensing apparatus 1 of the present embodiment can be an electrically operated foam dispensing apparatus including a reservoir portion 2 for storing the liquid 20, the nozzle portion 3, a liquid supply mechanism 4 that supplies the liquid 20 stored in the reservoir portion 2 to the nozzle portion 3, a gas supply mechanism 5 that takes in ambient air (gas) and supplies the air thus taken into the nozzle portion 3, and a control portion 6 that automatically drives the liquid supply mechanism 4 and the gas supply mechanism 5 for a fixed period of time in response to the input of a predetermined signal. The foam dispensing apparatus 1 of the present embodiment includes a non-contact sensor 7 that detects the foam receiver 8 such as a human hand or a cleaning sponge when placed under the nozzle portion 3. In response to the input of a detection signal when the sensor 7 detects the foam receiver 8, the control portion 6 automatically drives the liquid supply mechanism 4 and the gas supply mechanism 5 for a fixed period of time.

The reservoir portion 2 is composed of a container including a container body 21 and a cap 22 that can hermetically close an upper end opening of the container body 21. The liquid supply mechanism 4 includes a liquid pump 41 equipped with an electric motor, a first connection pipe 42, and a second connection pipe 43, and draws the liquid 20 from the reservoir portion 2 and supplies the drawn liquid 20 to the nozzle portion 3 while the liquid pump 41 is in operation under control of the control portion 6. As the liquid pump 41, for example, a centrifugal pump such as a vortex pump, or a positive displacement pump such as a syringe pump, a gear pump, a diaphragm pump, or a piezo pump is preferably used. The gas supply mechanism 5 includes an air pump 51 equipped with an electric motor and an air intake pipe 52, and draws external air from an intake vent (not shown) and supplies the drawn air to the nozzle portion 3 while the air pump 51 is in operation under control of the control portion 6. As the air pump 51, for example, a centrifugal pump such as a vortex pump, or a positive displacement pump such as a syringe pump, a gear pump, a diaphragm pump, or a piezo pump is preferably used.

As the first connection pipe 42, the second connection pipe 43, and the air intake pipe 52, rubber or synthetic resin tubes, metal pipes or the like are used. Preferably, the first connection pipe 42, the second connection pipe 43, and the air intake pipe 52 are flexible.

The control portion 6 includes a processor portion, a storage portion, and a power supply portion, and is electrically connected to the electric motor of the liquid pump 41, the electric motor of the air pump 51, and the sensor 7. The processor portion includes a microprocessor such as a CPU or an MPU. The storage portion includes a ROM or a RAM, and a program for the processor portion to perform predetermined processing and various types of data are stored in the storage portion. The control portion 6 performs control so as to start driving the electric motors of the liquid pump 41 and the air pump 51 in response to a signal detected by the sensor 7 when the foam receiver 8 such as a human hand or a cleaning sponge is placed under the nozzle portion 3. The power supply portion supplies power to the electric motors of the liquid pump 41 and the air pump 51, the control portion, and the like. The power supply portion is composed of a dry battery housing box, a secondary battery, a built-in or external AC-DC converter, or the like. As the sensor 7, it is possible to use any type of sensor known as, for example, a human presence sensor such as a pyroelectric sensor, or a sensor including an infrared light emitting diode and an infrared light receiving diode.

Figure 2:
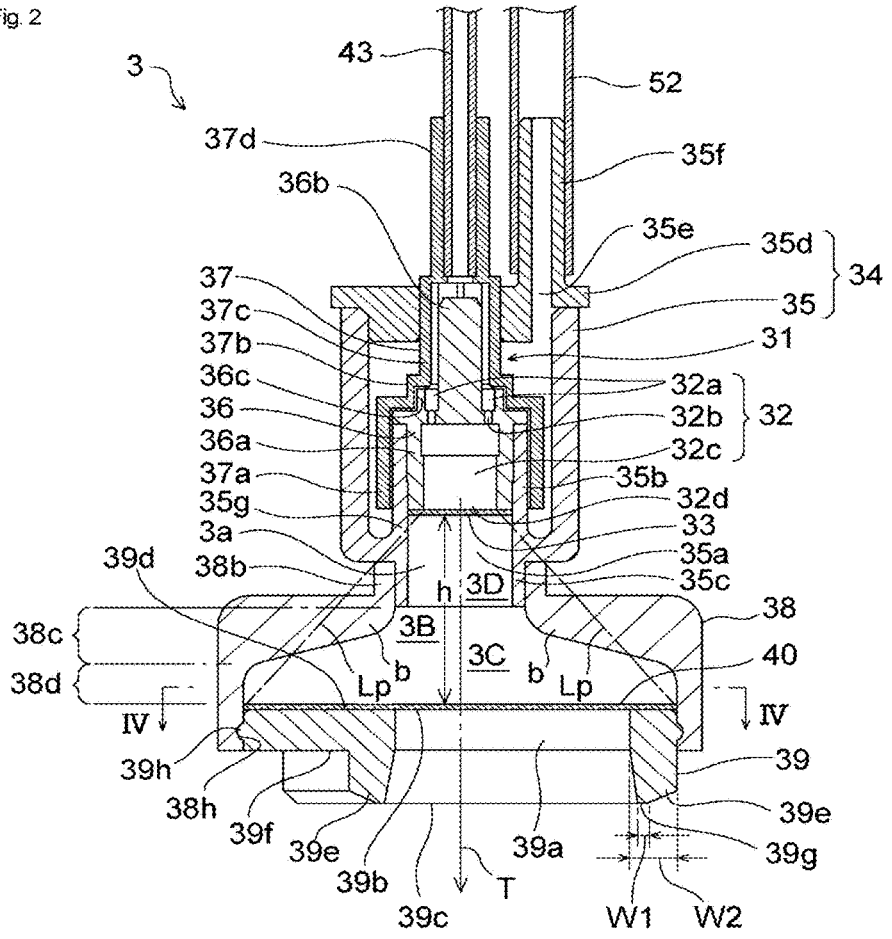
FIG. 2 is a vertical cross-sectional view of a nozzle portion included in the foam dispensing apparatus shown in FIG. 1.

As shown in FIG. 2, the nozzle portion 3 of the foam dispensing apparatus 1 includes a gas liquid mixing portion 32 in which a liquid and gas are mixed and a foam generation mechanism 31 including a first porous body 33 provided downstream of the gas liquid mixing portion 32. The gas liquid mixing portion 32 includes a confluent portion 32*a*, a communication path 32*b*, and a mixing chamber 32*c*.

The nozzle portion 3 includes a foamer case 34 having a tubular case main body 35 and a cap 35*d* hermetically attached to an upper end opening of the case main body 35. The foamer case 34 has a through hole 35*a* extending vertically through a bottom center of the foamer case 34, or to be more specific, a bottom center of the case main body 35. In a peripheral portion surrounding the through hole 35*a* in the bottom portion of the foamer case 34, a tubular support portion 35*b* protruding upward and a connection tubular portion 35*c* protruding downward are formed.

The foam generation mechanism 31 of the foam dispensing apparatus 1 of the present embodiment includes a foamer member 36 and a tubular joint member 37, and the gas liquid mixing portion 32 is formed by the foamer member 36 and the joint member 37. The confluent portion 32*a* of the gas liquid mixing portion 32 is formed in an annular recess portion between a guide rod portion 36*b* of the foamer member 36 and a protruding portion 36*c* located around the guide rod portion 36*b*, and the communication path 32*b* is a through hole extending from the annular recess portion to the mixing chamber 32*c*.

The foamer member 36 includes a cylindrical portion 36*a* that is fitted into an upper end portion of the tubular support portion 35*b* of the foamer case 34, and the mixing chamber 32*c* of the gas liquid mixing portion 32 is formed within the cylindrical portion 36*a* of the foamer member 36. That is, the interior of the cylindrical portion 36*a* serves as the mixing chamber 32*c* in which the content liquid is mixed with air. In the foamer member 36, the guide rod portion 36*b* for positional alignment protrudes upward while being supported from an inner circumferential surface of an upper end portion of the cylindrical portion 36*a*.

The joint member 37 includes a large-diameter tubular portion 37*a*, a small-diameter tubular portion 37*c*, and a connection tubular portion 37*d*. The large-diameter tubular portion 37*a* has an inner diameter similar to the outer diameter of the tubular support portion 35*b* of the foamer case 34. The small-diameter tubular portion 37*c* is provided continuous with the top of the large-diameter tubular portion 37*a* via a step portion 37*b*. The connection tubular portion 37*d* is provided continuous with the top of the small-diameter tubular portion 37*c* via a step portion. The joint member 37 is attached to the tubular support portion 35*b* by fitting the large-diameter tubular portion 37*a* to the upper end portion of the tubular support portion 35*b*, with the guide rod portion 36*b* of the foamer member 36 being inserted into the small-diameter tubular portion 37*c*. The guide rod portion 36*b* of the foamer member 36 is inserted into the small-diameter tubular portion 37*c* of the joint member 37 so as to facilitate positional alignment between the foamer member 36 and the joint member 37.

Also, the joint member 37 is held in the case main body 35, with the small-diameter tubular portion 37*c* extending vertically through the cap 35*d*, and a second connection pipe 43 of the liquid supply mechanism 4 is connected to the connection tubular portion 37*d* that is provided continuous with the top of the small-diameter tubular portion 37*c*. Specifically, an outer circumferential surface of the second connection pipe 43 comes into intimate contact with an inner circumferential surface of the connection tubular portion 37*d*. Also, a plurality of liquid flow grooves extending linearly in the lengthwise direction are formed on an inner circumferential surface of the small-diameter tubular portion 37*c*. The liquid supplied by the liquid supply mechanism 4 is transferred to the confluent portion 32*a* via the liquid flow grooves formed on the inner circumferential surface of the small-diameter tubular portion 37*c*, and merge with gas in the confluent portion 32*a*.

Also, in the cap 35*d*, a through hole 35*e* extending vertically through the cap 35*d* and a connection tubular portion 35*f* extending upward from around the through hole 35*e* are formed, and the connection tubular portion 35*f* is connected to the air intake pipe 52 of the gas supply mechanism 5. Specifically, an inner circumferential surface of the air intake pipe 52 is connected to an outer circumferential surface of the connection tubular portion 35*f*. Also, gas flow grooves extending linearly in the lengthwise direction are formed on an inner circumferential surface of the large-diameter tubular portion 37*a*. The air supplied by the gas supply mechanism 5 flows through a space between an inner circumferential surface of the foamer case 34 and an outer circumferential surface of the joint member 37, then enters the gas flow grooves from a lower end side of the joint member 37, and flows through the gas flow grooves into the confluent portion 32*a*. A plurality of gas flow grooves are also formed on an inner surface of a top surface portion of the large-diameter tubular portion 37*a* of the joint member 37 so as to extend in the horizontal direction, and a plurality of gas flow grooves are also formed on an inner surface of the step portion 37*b* so as to extend in the vertical direction.

The foamer member 36 has the tubular protruding portion 36*c* formed in a lower portion around the guide rod portion 36*b*. The protruding portion 36*c* is formed so as to be spaced apart by a fixed distance from an outer circumferential surface of the guide rod portion 36*b*, and thus an annular recess portion is formed between the guide rod portion 36*b* and the protruding portion 36*c*. The interior of the annular recess portion functions as the confluent portion 32*a* described above. In a bottom portion of the recess portion, a plurality of through holes extending vertically through the bottom portion are formed at predetermined intervals, and the through holes function as the communication path 32*b* described above. The above-described gas flow grooves also extend to an inner circumferential surface of the joint member 37 that is opposite to the tubular protruding portion 36*c*, and the air that has entered the gas flow grooves from the lower end side of the joint member 37 passes through the gas flow grooves to an upper end position of the tubular protruding portion 36*c*, and is ejected therefrom to the confluent portion 32*a* described above.

The liquid merged with gas in the confluent portion 32*a* is mixed with gas while flowing through the confluent portion 32*a*, the communication path 32*b*, and the mixing chamber 32*c* that constitute the gas liquid mixing portion 32 of the apparatus 1 so as to create coarse bubbles. Furthermore, as a result of the coarse bubbles passing through the first porous body 33 disposed in a lower end opening of the cylindrical portion 36*a* of the foamer member 36, which is a discharge outlet of the gas liquid mixing portion 32 in the apparatus 1 of the present embodiment, foamed foam composed of an aggregation of very fine bubbles is formed and then delivered to a foam dispensing path from a lower surface of the first porous body 33. As the first porous body 33, it is possible to use a mesh sheet made of a synthetic resin or a metal, a sintered compact made of metal particles, a sponge-like molded body made of a synthetic resin having a three-dimensional mesh structure, or the like. As the method for fixing the first porous body 33, any known method can be used such as heat sealing, ultrasonic sealing, using an adhesive, or fitting the first porous body 33 to a lower end portion of the large-diameter tubular portion 37*a*.

Also, as shown in FIG. 2, the nozzle portion 3 of the foam dispensing apparatus 1 includes, below the first porous body 33, a cavity 3B and a foam dispensing outlet 39*a* that dispenses the foam that has passed through the cavity 3B to the outside. The cavity 3B is a portion whose cross-sectional area defined by a plane perpendicular to a foam dispensing direction T is larger than the area of a discharge outlet 32*d* of the gas liquid mixing portion 32.

The area of the discharge outlet 32*d* of the gas liquid mixing portion 32 in the apparatus 1 of the present embodiment is the area of the lower end opening of the cylindrical portion 36*a* of the foamer member 36. Also, the expression "cross-sectional area defined by a plane perpendicular to the foam dispensing direction T" refers to the area of a cross section created by cutting along a plane.

As shown in FIG. 2, the cavity 3B in the apparatus 1 of the present embodiment includes a lower space 3C that is formed within a horizontal diffusion enhancing member 38 that is connected below the foamer case 34 and an upper space 3D that is located between the first porous body 33 and the lower space 3C. The upper space 3D is a portion that is located below the first porous body 33 in a hollow portion formed within a tubular body 35*g* that forms the through hole 35*a* in the bottom portion of the foamer case 34. The tubular body 35*g* in the apparatus 1 of the present embodiment is formed by the tubular support portion 35*b*, the through hole 35*a*, and the connection tubular portion 35*c* that were described above. The lower space 3C, on the other hand, is a portion that is located below the connection tubular portion 35*c* in a hollow portion formed within the horizontal diffusion enhancing member 38.

Each of the lower space 3C and the upper space 3D has a cross-sectional area defined by a plane perpendicular to the foam dispensing direction T that is larger than the area of the discharge outlet 32*d* of the gas liquid mixing portion 32 throughout the entire height direction of the nozzle portion 3.

The cavity 3B (the lower space 3C and the upper space 3D) is provided in a foam dispensing path 3*a* extending from the lower surface of the first porous body 33 to a lower end opening 39*c* of the foam dispensing outlet 39*a*, and a cross-sectional area defined by a plane perpendicular to the foam dispensing direction T of the foamed foam formed by the foam generation mechanism 31 rapidly expands in the cavity 3B, in particular in the lower space 3C. The reason that the cross-sectional area of the foamed foam expands is that the foamed foam is successively delivered into the cavity 3B from the first porous body 33 each time a fixed amount of foam is dispensed.

The horizontal diffusion enhancing member 38 includes an outer circumferential surface having a diameter larger than that of an outer circumferential surface of the foamer case 34, and a hollow portion extending through the horizontal diffusion enhancing member 38 in the vertical direction. The horizontal diffusion enhancing member 38 includes, in an upper end portion thereof, a connection tubular portion 38*b* protruding so as to surround the hollow portion, and the connection tubular portion 38*b* is connected below the foamer case 34 by the connection tubular portion 35*c* of the foamer case 34 fitted into the connection tubular portion 38*b*. The lower space 3C formed within the horizontal diffusion enhancing member 38 includes an inner circumferential surface having an internal diameter that is larger at its lower end than at its upper end, and its cross-sectional area defined by a plane perpendicular to the foam dispensing direction T expands downward from the top. Also, a dispensing outlet forming member 39 is fitted and fixed to a lower end portion of the hollow portion of the horizontal diffusion enhancing member 38. The lower space 3C of the present embodiment includes a cross-sectional area expanding portion 38*c* and a unchanging cross-sectional area portion 38*d*, the cross-sectional area expanding portion 38*c* being a portion in which its cross-sectional area defined by a plane perpendicular to the foam dispensing direction T gradually expands downward from the top, and the unchanging cross-sectional area portion 38*d* being a portion in which its cross-sectional area defined by a plane perpendicular to the foam dispensing direction T is constant throughout in the vertical direction. In the present embodiment, the upper space 3D also has a cross-sectional area defined by a plane perpendicular to the foam dispensing direction T that is constant throughout in the vertical direction.

The cross-sectional shape of the cavity 3B and the shapes of the foamer case 34 and the horizontal diffusion enhancing member 38 that form the cavity 3B are not limited to the shapes described in the present embodiment, and can be freely designed taking into consideration the design of the foam dispensing apparatus 1, the amount of foam dispensed, and the like. For example, the upper space 3D may be configured such that its cross-sectional area defined by a plane perpendicular to the foam dispensing direction T gradually expands downward from the top, and the lower space 3C does not necessarily include the unchanging cross-sectional area portion 38*d*. Also, an outer portion of the cross-sectional area expanding portion 38*c* of the horizontal diffusion enhancing member 38 may have a gradually expanding shape similar to the shape of the hollow portion.

As shown in FIG. 2, in a vertical cross-section of the nozzle portion 3 passing through the center of the cavity 3B, from the viewpoint of improving the dispensing response and the dripping prevention effect when the foam turns back into a liquid, it is preferable that an inner wall surface of the cavity 3B has a portion b that curves into the cavity inward of a virtual straight line Lp connecting an outer edge of the discharge outlet of the gas liquid mixing portion 32 and an outer edge of a second porous body 40, which will be described later, because the capacity of the cavity 3B is reduced.

Also, although not shown in the diagrams, it is also preferable that the inner wall surface of the cavity 3B is provided with a plurality of grooves or protruding portions extending outward and downward from a center side of the cavity 3B because the retention time of foamed foam in the cavity 3B can be extended, and the dripping prevention effect can be obtained when the foam turns back into a liquid. Also, the grooves or protruding portions are preferably provided radially. It is also preferable to provide the grooves or protruding portions at multiple levels in the height direction.

The dispensing outlet forming member 39 is fitted and fixed to a lower end portion of the horizontal diffusion enhancing member 38. The cavity 3B of the present embodiment is a space that extends from the lower surface of the first porous body 33 disposed in the discharge outlet of the gas liquid mixing portion 32 to an upper surface of the dispensing outlet forming member 39, and in which its cross-sectional area defined by a plane perpendicular to the foam dispensing direction T is larger than the area of the first porous body 33.

The foam dispensing direction T is a direction parallel to the center axis of the cavity 3B. If, for example, the cavity 3B is in a rotary form having a shape such as a cylindrical or cone shape, the foam dispensing direction T is a direction parallel to the rotation axis of the rotary form. If the direction of extension of the center axis of the cavity 3B is not definitively determined, the foam dispensing direction T is a direction that crosses an opening surface of the foam dispensing outlet 39*a* that is on the cavity 3B side, preferably a direction that is perpendicular to the same. It is preferable that the foam dispensing apparatus 1 is used by orienting the foam dispensing direction T of the nozzle portion 3 to match the vertical direction. In the present embodiment, the foam dispensing direction T from the discharge outlet 32*d* of the gas liquid mixing portion 32 extends along the vertical direction. Also, in the nozzle portion 3 of the present embodiment, a traveling direction in which the liquid 20 and the foam flow downward from the top extends along the vertical direction. The expression "match the vertical direction" encompasses cases where the foam dispensing direction T is parallel to the vertical direction as well as the case where the foam dispensing direction T is inclined from the vertical direction at an inclination angle of 5° or less.

Figure 3:
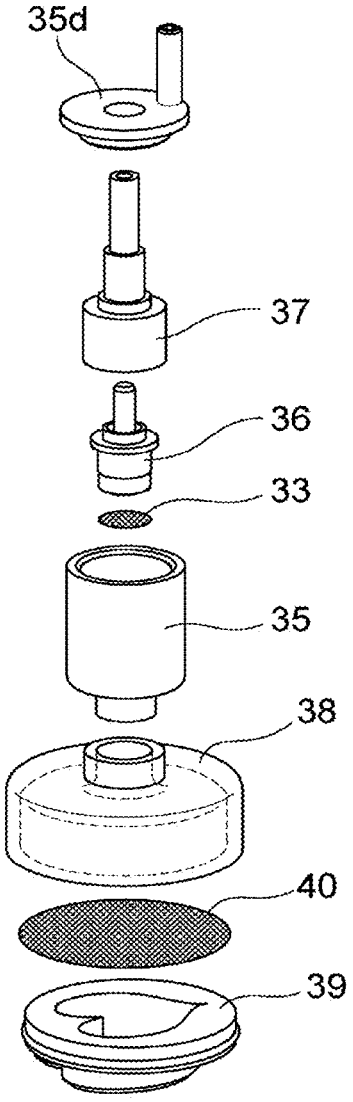
FIG. 3 is an exploded perspective view of the nozzle portion included in the foam dispensing apparatus shown in FIG. 1.

As shown in FIG. 3, the constituent members of the nozzle portion 3 of the present embodiment share the same center axis.

In the cavity 3B, the maximum value of the cross-sectional area defined by a plane perpendicular to the foam dispensing direction T is larger than the area of the discharge outlet of the gas liquid mixing portion 32 by a factor of preferably 2 or more, more preferably 10 or more, even more preferably 50 or more, and preferably 1000 or less, more preferably 200 or less, even more preferably 100 or less, and preferably 2 or more and 1000 or less, more preferably 10 or more and 200 or less, and even more preferably 50 or more and 100 or less.

Also, in the cavity 3B, the maximum value of the cross-sectional area defined by a plane perpendicular to the foam dispensing direction T is preferably 0.5 $cm^2$ or more, more preferably 2.8 $cm^2$ or more, and preferably 300 $cm^2$ or less, and more preferably 30 $cm^2$ or less.

The maximum value of the cross-sectional area of the cavity 3B is the cross-sectional area of a region of the cavity 3B having the largest cross-sectional area defined by a plane perpendicular to the foam dispensing direction T, and corresponds to the cross-sectional area of the unchanging cross-sectional area portion 38*d* in the nozzle portion 3 of the present embodiment. The cavity 3B preferably includes the region having the largest cross-sectional area in a region that is adjacent to the foam dispensing outlet 39*a* or immediately above the second porous body 40.

In the cavity 3B of the present embodiment, the cross-sectional area defined by a plane perpendicular to the foam dispensing direction T is larger than the area of the discharge outlet 32*d* of the gas liquid mixing portion over the entire region from the lower surface of the first porous body 33 to an upper surface of the dispensing outlet forming member 39, but the cavity of the present invention may have, in a portion of the foam dispensing direction T, a portion in which the cross-sectional area defined by a plane perpendicular to the foam dispensing direction T is smaller than the area of the discharge outlet of the gas liquid mixing portion.

The dispensing outlet forming member 39 is a member that forms the foam dispensing outlet 39*a* having a predetermined shape in the nozzle portion 3, and preferably is a member that forms the foam dispensing outlet 39*a* having a non-circular shape. The shape of the foam dispensing outlet 39*a* refers to the shape of the foam dispensing outlet 39*a* as viewed from the front (the shape as viewed from below the nozzle portion 3). FIGS. 1 to 5 show an example in which the foam dispensing outlet 39*a* has the shape of a heart on playing cards, which is a non-circular shape.

Figure 4:
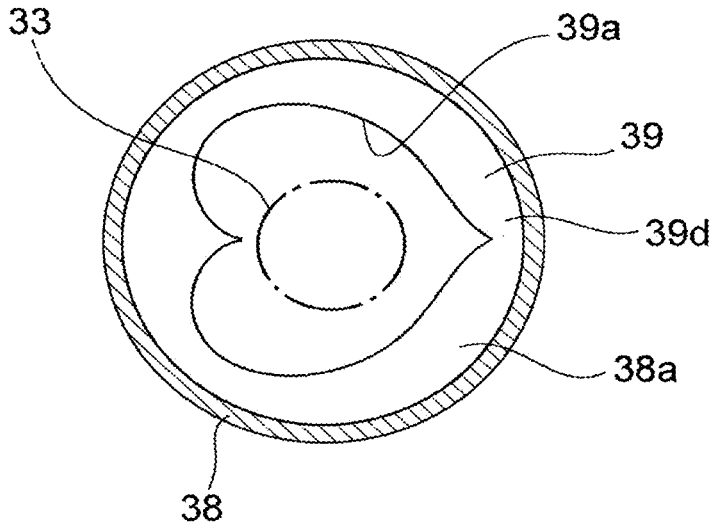
FIG. 4 is a cross-sectional view defined by the line IV-IV shown in FIG. 2, with an illustration of a second porous body being omitted.

As shown in FIGS. 2 and 4, in the nozzle portion 3 of the present embodiment, the opening area of the foam dispensing outlet 39*a* that is on the cavity 3B side is smaller than the maximum value of the cross-sectional area of the cavity 3B.

The foam dispensing outlet 39*a* includes an opening that is open on the cavity 3B side and an outer-side opening that is open on a side opposite to the cavity side. The opening area of the foam dispensing outlet 39*a* that is on the cavity 3B side is the area of the opening that is open on the cavity 3B side. In FIG. 4, the opening area corresponds to the internal area of the heart-shaped closed curve. The opening area of the foam dispensing outlet 39*a* that is on the cavity 3B side is preferably smaller than the cross-sectional area of the cavity 3B in a region adjacent to the foam dispensing outlet 39*a* (in the present embodiment, the region corresponding to the unchanging cross-sectional area portion 38*d* described above).

The opening area of the foam dispensing outlet 39*a* that is on the cavity 3B side is preferably 50% or less of the maximum value of the cross-sectional area of the cavity 3B, more preferably 30% or less, even more preferably 20% or less, and preferably 1% or more, more preferably 5% or more, and even more preferably 10% or more. Also, the opening area of the foam dispensing outlet 39*a* is preferably 1% or more and 50% or less of the maximum value of the cross-sectional area of the cavity 3B, more preferably 5% or more and 30% or less, and even more preferably 5% or more and 20% or less.

Also, the opening area of the foam dispensing outlet 39*a* is preferably 0.5 $cm^2$ or more, more preferably 1 $cm^2$ or more, and preferably 10 $cm^2$ or less, and more preferably 5 $cm^2$ or less.

Also, the opening area of the foam dispensing outlet 39*a* that is on the cavity 3B side is preferably larger than the area of the discharge outlet 32*d* of the gas liquid mixing portion 32 described above. The opening area of the foam dispensing outlet 39*a* that is on the cavity 3B side is larger than the area of the discharge outlet 32*d* of the gas liquid mixing portion 32 by a factor of 1 or more, more preferably 2 or more, and preferably 20 or less, more preferably 10 or less, and preferably one or more and 20 or less, and more preferably 2 or more and 10 or less.

There is no particular limitation on the opening shape of the foam dispensing outlet 39*a*, and the foam dispensing outlet 39*a* may have a shape composed of one closed opening formed in a heart shape as shown in FIG. 4, or may have a shape composed of a plurality of closed openings (for example, a shape composed of a plurality of spaced apart circles, or the like). That is, a plurality of foam dispensing outlets 39*a* may be provided with respect to one cavity 3B. In the case where the cavity 3B includes a plurality of foam dispensing outlets 39*a*, the total area of the opening areas of all foam dispensing outlets is defined as the opening area of the foam dispensing outlet.

The dispensing outlet forming member 39 of the present embodiment forms, in an upper surface of the dispensing outlet forming member 39 and around the foam dispensing outlet 39*a*, an annular continuous flat surface surrounding the foam dispensing outlet 39*a*.

The cavity 3B preferably has a flat surface 39*d* facing toward the cavity 3B in the periphery of the opening of the foam dispensing outlet 39*a* that is on the cavity 3B side, from the viewpoint of improving the diffusibility of foamed foam in a direction of extension of the foam dispensing outlet 39*a*. The flat surface 39*d* preferably extends in a direction perpendicular to the foam dispensing direction T, and is preferably an annular continuous flat surface surrounding the foam dispensing outlet 39*a* as in the present embodiment.

With the foam dispensing apparatus 1 of the present embodiment, when a foam receiver 8 such as a human hand or a cleaning sponge is placed under the nozzle portion 3, the sensor 7 detects the foam receiver 8 and transmits a detection signal to the control portion 6. The control portion 6 that has received the signal from the sensor 7 drives the liquid supply mechanism 4 and the gas supply mechanism 5 for a fixed period of time. A fixed amount of liquid is thereby supplied to the nozzle portion 3 by the liquid supply mechanism 4, and at the same time, a fixed amount of air is supplied to the nozzle portion 3 by the gas supply mechanism 5. As a result, a fixed amount of foamed foam is dispensed from the foam dispensing outlet of the nozzle portion 3 onto the foam receiver 8 such as a human hand or a cleaning sponge.

With the foam dispensing apparatus 1 of the present embodiment, the cavity 3B as described above is provided in the foam dispensing path 3*a* extending from the lower surface of the first porous body 33 to the lower end opening 39*c* of the foam dispensing outlet 39*a*, and the foam dispensing outlet 39*a* is provided downstream of the cavity 3B. Accordingly, the foamed foam flowing through the foam dispensing path 3*a* diffuses in a direction perpendicular to the foam dispensing direction T within the cavity 3B, and is dispensed from each region of the foam dispensing outlet 39*a* onto the foam receiver 8 such as the palm of the hand or a cleaning sponge at an average speed.

For this reason, by shaping the opening shape of the foam dispensing outlet 39*a*, shaped foam B having a desired contour, the contour being clear, can be formed on the palm or back of a human hand, the surface of a cleaning sponge, or the like. It is therefore possible to impart enjoyment and freshness to cleaning such as, for example, washing hands or the face by placing soap or a chemical solution onto the palm or back of the hand, or cleaning dishes, a bathroom or kitchen by applying soap or a chemical solution onto the surface of a cleaning sponge.

From this viewpoint, the foam dispensing outlet 39*a* of the nozzle portion 3 preferably has a non-circular shape as the front-on shape that is the shape when the foam dispensing outlet 39*a* is viewed from below the nozzle portion. The non-circular shape does not encompass a perfect circle and an ellipse or an oval whose ratio of the major axis to the minor axis (major-to-minor axis ratio) is less than 1.2, but it encompasses an ellipse or an oval whose ratio of the major axis to the minor axis (major-to-minor axis ratio) is 1.2 or more. The non-circular shape also encompasses the case where the foam dispensing outlet 39*a* is composed of a plurality of perfect circles, or ellipses or ovals whose ratio of the major axis to the minor axis (major-to-minor axis ratio) is less than 1.2. The non-circular shape encompasses various types of shapes excluding a perfect circle and an ellipse or an oval whose ratio of the major axis to the minor axis (major-to-minor axis ratio) is less than 1.2.

Examples of predetermined shapes of the shaped foam B formed by the foam dispensing outlet 39*a* having a non-circular shape include a triangular shape, a rectangular shape, a rhombic shape, a star-like shape, the shapes of a heart, clover, and spade on playing cards, a shape imitating the contour of an animal such as a rabbit, a cat, an elephant, or a bear, a shape imitating the contour of the whole body or a part of the body of a game character such as the face, a shape imitating the contour of a flower, a plant or a fruit, and a shape imitating the contour of a transportation vehicle such as an airplane, an automobile or a yacht. Examples of the non-circular shape as a preferred front-on shape of the foam dispensing outlet 39*a* include, in order to dispense any one of the shapes listed as examples of the shape of the shaped foam B, an ellipse or an oval whose ratio of the major axis to the minor axis (major-to-minor axis ratio) is 1.2 or more, a combination of a plurality of perfect circles, or ellipses or ovals whose ratio of the major axis to the minor axis (major-to-minor axis ratio) is less than 1.2, a shape having a contour composed only of a plurality of linear portions, a shape having a contour composed of a combination of a curved portion and a linear portion, a shape having a contour composed of a plurality of curved portions of different curvatures, a shape having a contour including a V-shaped bent portion, and a combination of two or more of the above-listed shapes. The oval shape refers to an elongated hole shape.

Figure 6:
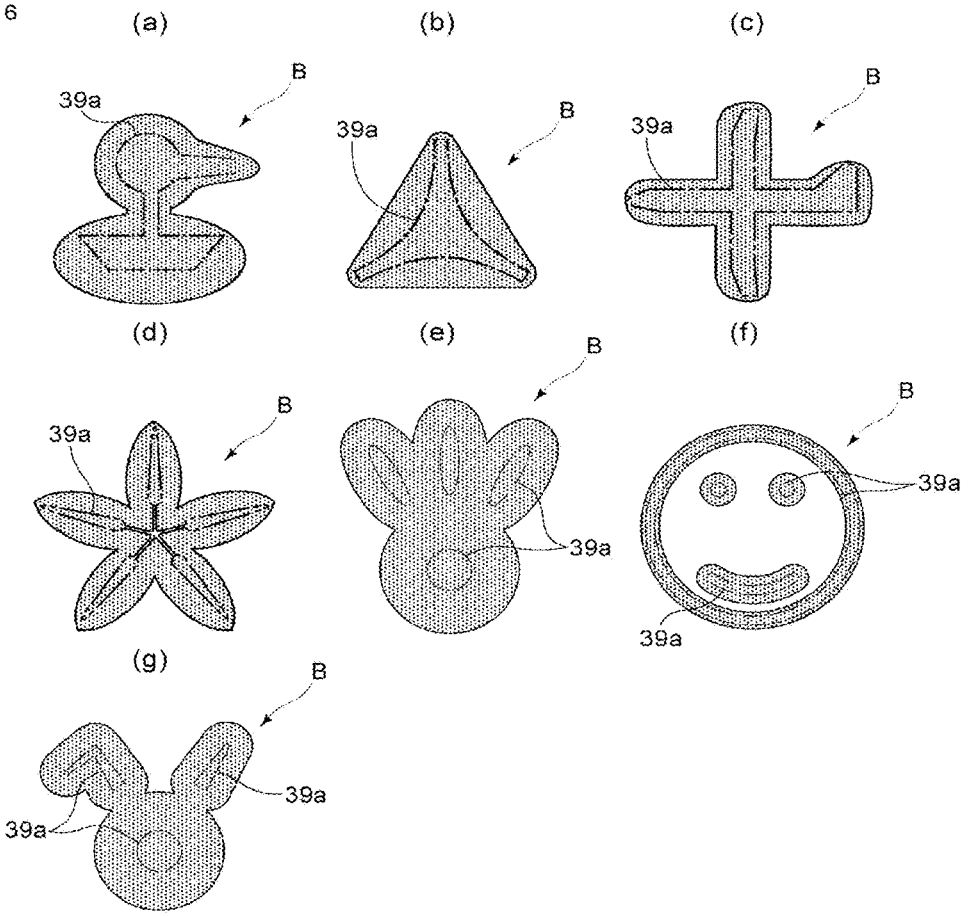
FIGS. 6(*a*) to 6(*g*) are schematic plan views each showing the shape of shaped foam as viewed in plan view that can be produced by the foam dispensing apparatus of the present invention and the shape of a foam dispensing outlet for obtaining the shaped foam.

FIGS. 6(*a*) to 6(*g*) are schematic plan views each showing the shape of shaped foam B as viewed in plan view that can be produced by the foam dispensing apparatus of the present invention and the shape of a foam dispensing outlet 39*a* for obtaining the shaped foam. FIG. 6(*a*) shows shaped foam B having a shape imitating the contour of the whole body of a duck, which is an example of an animal, and a foam dispensing outlet 39*a* having a non-circular shape for obtaining the shaped foam. FIG. 6(*b*) shows shaped foam B having a triangular shape and a foam dispensing outlet 39*a* having a non-circular shape for obtaining the shaped foam. FIG. 6(*c*) shows shaped foam B having a shape imitating the contour of an airplane, which is an example of a transportation vehicle, and a foam dispensing outlet 39*a* having a non-circular shape for obtaining the shaped foam. FIG. 6(*d*) shows shaped foam B having a shape imitating the contour of a flower and a foam dispensing outlet 39*a* having a non-circular shape for obtaining the shaped foam.

FIGS. 6(*e*) to 6(*g*) show non-circular foam dispensing outlets 39*a* that are composed of a plurality of circular or elliptic dispensing outlets and examples of shaped foam B that can be formed by the foam dispensing outlets 39*a*. FIG. 6(*e*) shows shaped foam B having the shape of a Japanese battledore shuttlecock and a foam dispensing outlet 39*a* having a non-circular shape for obtaining the shaped foam. FIG. 6(*f*) shows shaped foam B having a shape imitating an animal or a human face as viewed in plan view and a foam dispensing outlet 39*a* having a non-circular shape for obtaining the shaped foam. FIG. 6(*g*) shows a shaped foam B having a shape imitating the face of a rabbit, which is an example of a part of the body of an animal, and a foam dispensing outlet 39*a* having a non-circular shape for obtaining the shaped foam.

As shown in FIG. 2, the foam dispensing apparatus 1 of the present embodiment includes a second porous body 40 that is attached to the foam dispensing outlet 39*a* of the nozzle portion. As the second porous body 40, it is possible to use a mesh sheet made of a synthetic resin or a metal, a sintered compact made of metal particles, a sponge-like molded body made of a synthetic resin having a three-dimensional mesh structure, or the like. As the method for fixing the second porous body 40 to the foam dispensing outlet 39*a*, it is possible to use various types of methods such as, for example, a method in which the second porous body 40 is bonded to a peripheral portion surrounding the foam dispensing outlet 39*a* in an upper end surface of the dispensing outlet forming member 39 through heat sealing, ultrasonic sealing, using an adhesive or the like, or a method in which the second porous body 40 formed to have an outer circumferential surface having a shape similar to the shape of the inner circumferential surface of the foam dispensing outlet 39*a* is fitted within the foam dispensing outlet 39*a*.

As a result of the second porous body 40 being attached to the foam dispensing outlet 39*a*, the foamed foam supplied via the first porous body 33 diffuses very well in the horizontal direction in the cavity 3B, and is dispensed from the foam dispensing outlet 39*a* at an average speed over the entire region of the foam dispensing outlet 39*a*.

Shaped foam B having a clearer contour shape is thereby formed on the surface of the foam receiver 8 such as the palm of a human hand. Also, due to the presence of the second porous body 40, a much finer foamed foam can be obtained, and thus shaped foam B having a shape with a clear contour can be obtained more easily. The pore size of the second porous body 40 may be the same as that of the first porous body 33, or may be different from that of the first porous body 33.

It is preferable that the second porous body 40 has an area (the area of the upper surface or the lower surface) that is larger than or equal to the opening area of the foam dispensing outlet 39*a* that is on the cavity 3B side or the outer-side opening, more preferably larger than the opening area of the foam dispensing outlet 39*a* that is on the cavity 3B side. It is even more preferable that, in the case where the second porous body 40 is disposed on the cavity 3B side of the dispensing outlet forming member 39, the second porous body 40 is provided over the entire surface of the dispensing outlet forming member 39 that is on the cavity 3B side. In the foam dispensing apparatus 1 of the present embodiment, a bottom surface of the cavity 3B is formed of the upper surface of the dispensing outlet forming member 39, and the second porous body 40 is provided over the entire region of the upper surface of the dispensing outlet forming member 39, the entire region including a region overlapping the foam dispensing outlet 39*a*.

Also, the area (the area of the upper surface or the lower surface) of the second porous body 40 is preferably larger than the area of the discharge outlet 32*d* of the gas liquid mixing portion 32.

From the viewpoint of facilitating the formation of a shaped foam B having a clear contour shape, a distance h extending from the first porous body 33 to the opening of the foam dispensing outlet 39*a* that is on the cavity side (see FIG. 2) is preferably 10% or more of an equivalent circle diameter of the cavity calculated from the maximum value of the cross-sectional area of the cavity 3B, more preferably 20% or more, and preferably 100% or less, and more preferably 50% or less.

The distance h (see FIG. 2) is preferably smaller than the equivalent circle diameter of the cavity.

Figure 5:
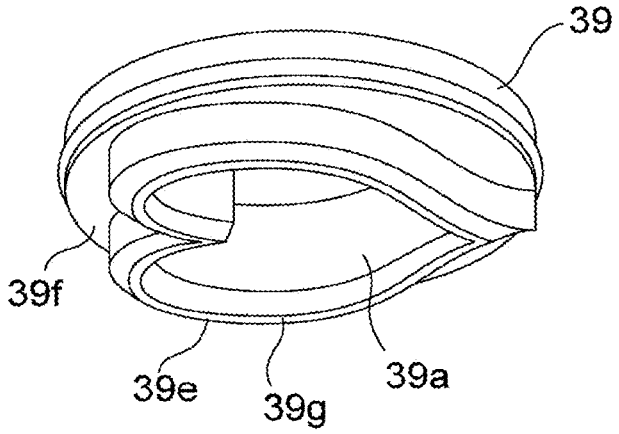
FIG. 5 is a perspective view of nozzle portion forming members shown in FIGS. 2 and 3 as viewed from obliquely below.

As shown in FIGS. 2 and 5, in the foam dispensing outlet 39*a* of the nozzle portion 3 of the foam dispensing apparatus 1 of the present embodiment, an opening peripheral portion 39*e* of the outer-side opening protrudes in the foam dispensing direction T. As used herein, the term "outer-side opening" refers to an opening that is open on a side opposite to the opening that is on the cavity 3B side. Under normal use of the foam dispensing apparatus 1, the opening peripheral portion 39*e* protrudes downward of the nozzle portion 3. Also, as shown in FIG. 2, the protruding opening peripheral portion 39*e* has a smaller width W1 at its tip end than a width W2 on a base end 39*f* side in the protruding direction. The width W2 and the width W1 as used herein refer to, as shown in FIG. 2, widths extending in a direction perpendicular to the direction of extension of the opening peripheral portion 39*e* (the circumferential direction of the foam dispensing outlet 39*a*). As a result of configuring the opening peripheral portion 39*e* that is on the outer side so as to protrude, it is possible to prevent the foamed foam dispensed from the foam dispensing outlet 39*a* from being attached to the periphery of the foam dispensing outlet 39*a* and causing disfigurement of the shape of the foam, and thus shaped foam B having a desired shape can be easily obtained. Also, as a result of configuring the protruding opening peripheral portion 39*e* such that the width W1 at the tip end is smaller than the width W2 on the base end side, it is possible to further reduce the attachment of the foam to the periphery of the foam dispensing outlet 39*a*, and thus shaped foam B having a clear contour shape can be obtained more easily.

From the same viewpoint, as shown in FIG. 2, it is more preferable to configure the protruding opening peripheral portion 39*e* such that the cross-sectional shape of the tip end portion becomes narrower toward the end. It is also preferable that the protruding opening peripheral portion 39*e* has a tapered surface inclined with respect to the foam discharging direction T on each side of the tip end portion in the protruding direction.

In a tip end 39*g* of the protruding opening peripheral portion 39*e*, the width W1 extending in a direction perpendicular to the direction of extension of the opening peripheral portion 39*e* (the circumferential direction of the foam dispensing outlet 39*a*) is preferably 3 mm or less, more preferably 2 mm or less, even more preferably 1 mm or less, and preferably greater than 0 mm, more preferably 0.2 mm or more, and even more preferably 0.3 mm or more. FIGS. 2 and 5 show examples in which the protruding opening peripheral portion 39*e* has an annular flat surface having a small width at the tip end 39*g*, but the protruding opening peripheral portion 39*e* does not need to have a flat surface at its tip end.

Also, in the foam dispensing apparatus 1 of the present embodiment, the horizontal diffusion enhancing member 38 and the dispensing outlet forming member 39 are connected, without boundary portions therebetween being bonded to each other, by fitting a protruding rib 39*h* that is formed on the outer circumferential surface of the dispensing outlet forming member 39 into a recessed groove 38*h* that is formed on the inner circumferential surface of the horizontal diffusion enhancing member 38. Accordingly, the position of the foam dispensing outlet 39*a* can be changed about the rotation axis extending in the foam dispensing direction T by manually rotating the dispensing outlet forming member 39.

For example, by changing the orientation of the foam dispensing outlet 39*a* using the above-described method, foam shaped into a predetermined shape can be dispensed in a desired orientation onto the foam receiver 8 such as the palm of the hand. If the foam dispensing outlet 39*a* is configured such that its orientation cannot be changed, the orientation of the shaped foam B formed on the palm of the hand varies depending on when the foam dispensing apparatus 1 is installed on the back of a wash basin, with the nozzle portion being positioned in the front, when the foam dispensing apparatus 1 is installed on the left side of a wash basin, with the nozzle portion being positioned on the right side, and when the foam dispensing apparatus 1 is installed on the right side of a wash basin, with the nozzle portion being positioned on the left side. However, by configuring the foam dispensing outlet 39*a* such that its orientation can be changed, the shaped foam B can be formed in the same orientation on the palm of the hand irrespective of the installation location of the foam dispensing apparatus 1 by changing the orientation of the foam dispensing outlet 39*a* of the installation location of the foam dispensing apparatus 1.

As the method for changing the position of the foam dispensing outlet 39*a* about the rotation axis extending in the foam dispensing direction T, it is also possible to use, instead of the method in which the horizontal diffusion enhancing member 38 and the dispensing outlet forming member 39 are connected so as to be capable of rotation, a method in which the foamer case 34 and the horizontal diffusion enhancing member 38 are configured so as to be capable of rotating, and a method in which the nozzle portion 3 is attached to the foam dispensing apparatus 1 such that the nozzle portion 3 as a whole can be rotated.

In addition, as the method for changing the position of the foam dispensing outlet 39*a* about the rotation axis extending in the foam dispensing direction T, it is also possible to use a method in which the dispensing outlet forming member 39 is configured so as to be capable of detaching from the horizontal diffusion enhancing member 38 such that the dispensing outlet forming member 39 can be detached from the horizontal diffusion enhancing member 38 and rotated so as to change the orientation of the foam dispensing outlet 39*a*, and then attached again to the horizontal diffusion enhancing member 38. Employing a configuration in which the dispensing outlet forming member 39 is capable of detachment provides advantages such as improving the maintainability and ease of changing of the shape of shaped foam.

The nozzle portion 3 may be entirely made of a synthetic resin, or may be entirely or partially made of a material other than a synthetic resin such as a metal or ceramic. As the synthetic resin, it is possible to use, for example, polyolefins such as polyethylene and polypropylene, polystyrene, polyethylene terephthalate (PET), polycarbonate, acrylic resin, polyamide, polyacetal, vinyl chloride, and the like.

Also, from the viewpoint of enhancing the shape retainability of the shaped foam B formed on the foam receiver 8, the foam dispensed from the nozzle portion 3 preferably has a gas-to-liquid ratio (air:liquid), which is the ratio of air to liquid, of 5:1 to 100:1, and more preferably 10:1 to 50:1. The foam having such a gas-to-liquid ratio can be obtained by adjusting the speed of the gas and liquid delivered to the nozzle portion 3 and the speed ratio, or adjusting the viscosity of the liquid.

Also, from the viewpoint of enhancing the formation of shaped foam B having a predetermined shape, the amount of foam (apparent volume) dispensed each time is preferably 5 $cm^3$ or more, more preferably 10 $cm^3$ or more, and preferably 100 $cm^3$ or less, and more preferably 50 $cm^3$ or less. Also, the amount of foam dispensed each time is preferably 5 $cm^3$ or more and 100 $cm^3$ or less, and more preferably 10 $cm^3$ or more and 50 $cm^3$ or less.

The amount of foam dispensed can be measured by placing the dispensed foam in a container in an environment with a normal temperature, normal humidity and normal pressure (20° C., 40 RH %, and 1 atm pressure), the container being a container whose volume can be measured such as a measuring cylinder or a measuring cup, or a container whose capacity is known.

Also, from the viewpoint of shape stability of dispensed foam and preventing dripping, the capacity of the cavity 3B is larger than the amount of foam (apparent volume) dispensed each time by a factor of preferably 0.05 to 2, more preferably 0.1 to 1, and even more preferably 0.2 to 0.8. Also, the ratio of the capacity of the cavity 3B to the amount of foam (apparent volume) dispensed each time is preferably less than 1 when the frequency of use of the foam dispensing apparatus 1 is low.

The capacity of the cavity 3B is the capacity of a space extending from the lower surface of the first porous body 33 to the position of an opening 39*b* of the foam dispensing outlet 39*a* that is on the cavity 3B side. Even if, for example, the second porous body 40 is disposed on an upper surface 39*d* of the dispensing portion forming member where the foam dispensing outlet 39*a* is open as shown in FIG. 2, the capacity of the cavity 3B is obtained assuming that the second porous body 40 is not disposed therein. Also, if there is a portion having a cross-sectional area that is smaller than the area of the discharge outlet of the gas liquid mixing portion at a position between the lower surface of the first porous body 33 and the upper surface 39*d* of the dispensing portion forming member where the foam dispensing outlet 39*a* is open, the cross-sectional area being a cross-sectional area defined by a plane perpendicular to the foam dispensing direction, the capacity of the cavity 3B is obtained by including the capacity of that portion.

The present invention is not limited to the embodiment given above, and various modifications can be made.

For example, the nozzle portion of the embodiment described above is composed of a plurality of members, but may be replaced by a member obtained by integrally molding two or more members, or a member obtained by connecting a plurality of members, each being an integrally molded member. It is also possible to provide a plurality of foam dispensing outlets 39*a*. In this case, the foam that has passed through the common cavity 3B is dispensed from the plurality of foam dispensing outlets 39*a*.

Also, the foam dispensing apparatus may be an electrically operated foam dispensing apparatus configured to detect a signal from a push button or a contact sensor instead of a non-contact sensor, and start supplying gas and the liquid to the nozzle portion. Also, the liquid supply mechanism may be configured such that gas is delivered into the reservoir portion by an electric air pump or the like, and when the liquid surface is pressed by the delivered gas, the pressed content liquid is delivered to the nozzle portion via a plastic tube having one end immersed in the content liquid.

The foam dispensing apparatus of the present invention may be a manually operated apparatus. For example, air and the liquid may be delivered to the foam generation mechanism of the nozzle portion in response to a pressing operation of the pump head. Also, the foam dispensing apparatus 1 of the embodiment described above may be configured as a portable apparatus by housing all constituent elements in a casing provided with a hand placing portion or by holding all constituent elements on a substrate, or may be configured as a non-portable apparatus by fixing the constituent elements other than the nozzle portion and its support portion below a wash basin.

The liquid may be, other than a cleaning agent such as liquid soap, a hand sanitizing solution that can be foamed by adding an activator agent, a hair care preparation such as a hair styling agent, a hair fixing agent or a hair growing agent, skin care preparation such as a lotion, an emulsion or a cosmetic serum, a shaving foam, a dish washing agent, or the like. Also, air is normally used as the gas, but a gas such as nitrogen or helium may be used instead of air.

With respect to the embodiment described above, the present invention further discloses the following additional statements (foam dispensing apparatus and the like).

<1>

A foam dispensing apparatus including a nozzle portion that mixes a liquid with gas so as to dispense the liquid in a form of foam, wherein the nozzle portion includes:

a foam generation mechanism including a gas liquid mixing portion in which the liquid and the gas are mixed and a first porous body that is disposed in a discharge outlet of the gas liquid mixing portion;

a cavity that is located below the first porous body and whose cross-sectional area defined by a plane perpendicular to a foam dispensing direction is larger than an area of the discharge outlet of the gas liquid mixing portion; and a foam dispensing outlet that dispenses a foam that has passed through the cavity to an outside, and an opening area of the foam dispensing outlet that is on the cavity side is smaller than a maximum value of the cross-sectional area of the cavity.

<2>

The foam dispensing apparatus as set forth in clause <1> above, wherein the opening area of the foam dispensing outlet that is on the cavity side is smaller than the cross-sectional area of the cavity in a region adjacent to the foam dispensing outlet.

<3>

The foam dispensing apparatus as set forth in clause <1> or <2> above, wherein the foam dispensing apparatus is an electrically operated fixed-amount dispensing apparatus that dispenses a fixed amount of foam from the foam dispensing outlet and includes a liquid supply mechanism that supplies a fixed amount of liquid to the gas liquid mixing portion and a gas supply mechanism that supplies a fixed amount of gas to the gas liquid mixing portion.

<4>

The foam dispensing apparatus as set forth in any one of clauses <1> to <3> above, wherein the foam dispensing apparatus includes a second porous body in the foam dispensing outlet.

<5>

The foam dispensing apparatus as set forth in any one of clauses <1> to <4> above, wherein, in the foam dispensing outlet, an opening peripheral portion of an outer-side opening protrudes in the foam dispensing direction.

<6>

The foam dispensing apparatus as set forth in clause <5> above, wherein the protruding opening peripheral portion has a smaller width at a tip end thereof than a width on a base end side thereof in a protruding direction thereof, the widths being widths extending in a direction perpendicular to a circumferential direction of the foam dispensing outlet.

<7>

The foam dispensing apparatus as set forth in any one of clauses <1> to <6> above, wherein the opening peripheral portion of the outer-side opening of the foam dispensing outlet includes a tip end whose width in the direction perpendicular to the circumferential direction of the foam dispensing outlet is 3 mm or less.

<8>

The foam dispensing apparatus as set forth in any one of clauses <5> to <7> above, wherein the protruding opening peripheral portion has a tapered surface inclined with respect to the foam dispensing direction on each side of the tip end side in the protruding direction.

<9>

The foam dispensing apparatus as set forth in any one of clauses <1> to <8> above, wherein the foam dispensing outlet is configured such that a position thereof can be changed about a rotation axis extending in the foam dispensing direction.

<10>

The foam dispensing apparatus as set forth in any one of clauses <1> to <9> above, wherein, in a vertical cross-section of the nozzle portion passing through a center of the cavity, an inner wall surface of the cavity has a portion that curves into the cavity inward of a virtual straight line connecting an outer edge of the discharge outlet of the gas liquid mixing portion and an outer edge of the second porous body.

<11>

The foam dispensing apparatus as set forth in any one of clauses <1> to <10> above, wherein the inner wall surface of the cavity is provided with a plurality of grooves or protruding portions extending outward and downward from a center side of the cavity.

<12>

The foam dispensing apparatus as set forth in clause <11> above, wherein the grooves or the protruding portions are provided radially.

<13>

The foam dispensing apparatus as set forth in any one of clauses <1> to <12> above, wherein the foam dispensing direction of the nozzle portion matches a vertical direction when the foam dispensing apparatus is used.

<14>

The foam dispensing apparatus as set forth in any one of clauses <1> to <13> above, wherein the maximum value of the cross-sectional area of the cavity is larger than the area of the discharge outlet of the gas liquid mixing portion by a factor of preferably 2 or more, more preferably 10 or more, even more preferably 50 or more, and preferably 1000 or less, more preferably 200 or less, even more preferably 100 or less, and preferably 2 or more and 1000 or less, more preferably 10 or more and 200 or less, and even more preferably 50 or more and 100 or less.

<15>

The foam dispensing apparatus as set forth in any one of clauses <1> to <14> above, wherein the opening area of the foam dispensing outlet that is on the cavity side is larger than the area of the discharge outlet of the gas liquid mixing portion by a factor of preferably 1 or more, more preferably 2 or more, and preferably 20 or less, more preferably 10 or less, and preferably 1 or more and 20 or less, and more preferably 2 or more and 10 or less.

<16>

The foam dispensing apparatus as set forth in any one of clauses <1> to <15> above, wherein the opening area of the foam dispensing outlet is preferably 50% or less of the maximum value of the cross-sectional area of the cavity, more preferably 30% or less, even more preferably 20% or less, and 1% or more, preferably 5% or more, even more preferably 10% or more, and specifically, 1% or more and 50% or less, preferably 5% or more and 30% or less, and more preferably 5% or more and 20% or less.

<17>

The foam dispensing apparatus as set forth in any one of clauses <1> to <16> above, wherein the cavity has a flat surface facing toward the cavity in the periphery of an opening of the foam dispensing outlet that is on the cavity side.

<18>

The foam dispensing apparatus as set forth in any one of clauses <1> to <17> above, wherein the foam dispensing outlet has a non-circular shape as a front-on shape that is a shape as viewed from below the nozzle portion.

<19>

The foam dispensing apparatus as set forth in clause <18> above, wherein the non-circular shape of the foam dispensing outlet is selected from an ellipse or an oval whose ratio of a major axis to a minor axis (major-to-minor axis ratio) is 1.2 or more, a combination of a plurality of perfect circles, or ellipses or ovals whose ratio of the major axis to the minor axis (major-to-minor axis ratio) is less than 1.2, a shape having a contour composed only of a plurality of linear portions, a shape having a contour composed of a combination of a curved portion and a linear portion, a shape having a contour composed of a plurality of curved portions of different curvatures, a shape having a contour including a V-shaped bent portion, and a combination of two or more of the above-listed shapes.

<20>

The foam dispensing apparatus as set forth in any one of clauses <1> to <19> above, wherein the first porous body is a mesh sheet made of a synthetic resin or a metal, a sintered compact made of metal particles, or a sponge-like molded body made of a synthetic resin having a three-dimensional mesh structure.

<21>

The foam dispensing apparatus as set forth in any one of clauses <1> to <20> above, wherein the foam dispensing apparatus includes a second porous body in the foam dispensing outlet, and the second porous body is a mesh sheet made of a synthetic resin or a metal, a sintered compact made of metal particles, or a sponge-like molded body made of a synthetic resin having a three-dimensional mesh structure.

<22>

The foam dispensing apparatus as set forth in clause <21> above, wherein the foam dispensing apparatus includes the second porous body in the foam dispensing outlet, and the second porous body has an area larger than or equal to an opening area of the foam dispensing outlet that is on the cavity side or the outer-side opening.

<23>

The foam dispensing apparatus as set forth in clause <22> above, wherein the second porous body has an area larger than the opening area of the foam dispensing outlet that is on the cavity side.

<24>

The foam dispensing apparatus as set forth in any one of clauses <1> to <23> above, wherein a bottom surface of the cavity is formed of an upper surface of a dispensing outlet forming member, and the second porous body is provided over an entire region of an upper surface of the dispensing outlet forming member, the entire region including a region overlapping the foam dispensing outlet.

<25>

The foam dispensing apparatus as set forth in any one of clauses <1> to <24> above, wherein a bottom portion of the cavity is formed of the dispensing outlet forming member, the second porous body is disposed on the cavity side of the dispensing outlet forming member, and the second porous body is provided over an entire surface of the dispensing outlet forming member that is on the cavity side.

<26>

The foam dispensing apparatus as set forth in any one of clauses <1> to <25> above, wherein the foam dispensing apparatus includes the second porous body in the foam dispensing outlet, and the second porous body has an area larger than the area of the discharge outlet of the gas liquid mixing portion.

<27>

The foam dispensing apparatus as set forth in any one of clauses <1> to <26> above, wherein a distance h extending from the first porous body to the opening of the foam dispensing outlet that is on the cavity side is preferably 10% or more, more preferably 20% or more, and preferably 100% or less, and more preferably 50% or less of an equivalent circle diameter of the cavity calculated from the maximum value of the cross-sectional area of the cavity.

<28>

The foam dispensing apparatus as set forth in any one of clauses <1> to <27> above, wherein the cavity has a capacity of 0.05 to 2 times, preferably 0.1 to 1 times, and more preferably 0.2 to 0.8 times of an amount of foam (apparent volume) dispensed each time.

<29>

The foam dispensing apparatus as set forth in any one of clauses <1> to <28> above, wherein the foam dispensing outlet is configured so as to form a shaped foam having a predetermined shape.

<30>

The foam dispensing apparatus as set forth in any one of clauses <1> to <29> above, wherein the foam having a predetermined shape dispensed from the foam dispensing outlet has a shape selected from a triangular shape, a rectangular shape, a rhombic shape, a star-like shape, a clover shape, a spade shape, a shape imitating a contour of a whole body or a part of body of an animal or a character, a shape imitating a contour of a flower, a plant or a fruit, and a shape imitating a contour of a transportation vehicle.

INDUSTRIAL APPLICABILITY

With the foam dispensing apparatus of the present invention, it is possible to form a shaped foam having a desired predetermined shape in a stable manner.

The invention claimed is:

1. A foam dispensing apparatus comprising a nozzle portion that mixes a liquid with gas so as to dispense the liquid in a form of foam, wherein the nozzle portion includes:

a foam generation mechanism including a gas liquid mixing portion in which the liquid and the gas are mixed and a first porous body that is disposed in a discharge outlet of the gas liquid mixing portion;

a cavity that is located below the first porous body and whose cross-sectional area defined by a plane perpendicular to a foam dispensing direction is larger than an area of the discharge outlet of the gas liquid mixing portion;

a foam dispensing outlet that dispenses a foam that has passed through the cavity to an outside; and a second porous body in the foam dispensing outlet, wherein the foam dispensing outlet is configured so as to form a shaped foam having a predetermined shape, wherein an opening area of the foam dispensing outlet that is on the cavity side is smaller than a maximum value of the cross-sectional area of the cavity, wherein the inner wall surface of the cavity has a portion that is radially inward of the outer edge of the second porous body, and wherein, in a vertical cross-section of the nozzle portion passing through a center of the cavity, the portion of the inner wall surface of the cavity is inward of a virtual straight line connecting an outer edge of the discharge outlet of the gas liquid mixing portion and the outer edge of the second porous body.

2. The foam dispensing apparatus according to claim 1, wherein the opening area of the foam dispensing outlet that is on the cavity side is smaller than the cross-sectional area of the cavity in a region adjacent to the foam dispensing outlet.

3. The foam dispensing apparatus according to claim 1, wherein the foam dispensing apparatus is an electrically operated fixed-amount dispensing apparatus that dispenses a fixed amount of foam from the foam dispensing outlet and includes a liquid supply mechanism that supplies a fixed amount of liquid to the gas liquid mixing portion and a gas supply mechanism that supplies a fixed amount of gas to the gas liquid mixing portion.

4. The foam dispensing apparatus according to claim 1, wherein, in the foam dispensing outlet, an opening peripheral portion of an outer-side opening protrudes in the foam dispensing direction.

5. The foam dispensing apparatus according to claim 4, wherein the protruding opening peripheral portion has a smaller width at a tip end thereof than a width on a base end side thereof in a protruding direction thereof, the widths being widths extending in a direction perpendicular to a circumferential direction of the foam dispensing outlet.

6. The foam dispensing apparatus according to claim 1, wherein the opening peripheral portion of the outer-side opening of the foam dispensing outlet includes a tip end whose width in a direction perpendicular to the circumferential direction of the foam dispensing outlet is 3 mm or less.

7. The foam dispensing apparatus according to claim 4, wherein the protruding opening peripheral portion has a tapered surface inclined with respect to the foam dispensing direction on each side of the tip end side in the protruding direction.

8. The foam dispensing apparatus according to claim 1, wherein the foam dispensing outlet is configured such that a position thereof can be changed about a rotation axis extending in the foam dispensing direction.

9. The foam dispensing apparatus according to claim 1, wherein the inner wall surface of the cavity is provided with a plurality of grooves or protruding portions extending outward and downward from a center side of the cavity.

10. The foam dispensing apparatus according to claim 1, wherein the foam dispensing outlet has a non-circular shape as a front-on shape that is a shape as viewed from below the nozzle portion.

11. The foam dispensing apparatus according to claim 1, wherein the maximum value of the cross-sectional area of the cavity is larger than the area of the discharge outlet of the gas liquid mixing portion by a factor of 2 or more and 1000 or less.

12. The foam dispensing apparatus according to claim 1, wherein the opening area of the foam dispensing outlet that is on the cavity side is larger than the area of the discharge outlet of the gas liquid mixing portion by a factor of 1 or more and 20 or less.

13. The foam dispensing apparatus according to claim 1, wherein the opening area of the foam dispensing outlet is 1% or more and 50% or less of the maximum value of the cross-sectional area of the cavity.

14. The foam dispensing apparatus according to claim 1, wherein a distance extending from the first porous body to the opening of the foam dispensing outlet that is on the cavity side is 10% or more and 100% or less of an equivalent circle diameter of the cavity calculated from the maximum value of the cross-sectional area of the cavity.

15. The foam dispensing apparatus according to claim 1, wherein the cavity has a capacity of 0.05 to 2 times of an amount of foam dispensed each time.

16. The foam dispensing apparatus according to claim 1, wherein a cross-sectional area of the opening area of the foam dispensing outlet is at all times greater than a cross-sectional area of the discharge outlet of the gas liquid mixing portion.

17. The foam dispensing apparatus according to claim 1, wherein the cavity is defined by a first unchanging cross-sectional area, followed by a cross-sectional expanding portion that continually expands, followed by a second unchanging cross-sectional area.

18. The foam dispensing apparatus according to claim 1, wherein, in the foam dispensing outlet, an opening peripheral portion of an outer-side opening protrudes in the foam dispensing direction, wherein the protruding opening peripheral portion has a smaller width at a tip end thereof than a width on a base end side thereof in a protruding direction thereof, the widths being widths extending in a direction perpendicular to a circumferential direction of the foam dispensing outlet, and wherein the foam dispensing outlet has a non-circular shape as a front-on shape that is a shape as viewed from below the nozzle portion.

19. The foam dispensing apparatus according to claim 1, wherein the second porous body has an outer edge that contacts respective radially inward-facing portions of an inner wall surface of the cavity.

* * * * *